US005154429A

United States Patent [19]

LeVasseur

[11] Patent Number: 5,154,429

[45] Date of Patent: Oct. 13, 1992

[54] METHOD OF PLAYING MULTIPLE ACTION BLACKJACK

[75] Inventor: Richard A. LeVasseur, Las Vegas, Nev.

[73] Assignee: Four Queens, Inc., Las Vegas, Nev.

[21] Appl. No.: 840,393

[22] Filed: Feb. 24, 1992

[51] Int. Cl.[5] ..... A63F 1/00

[52] U.S. Cl. ..... 273/292; 273/309; 273/274; 273/85 CP

[58] Field of Search ..... 273/292, 274, 309, 303, 273/85 CP

[56] References Cited

U.S. PATENT DOCUMENTS

| | | | |
|---|---|---|---|
| 4,614,342 | 9/1986 | Takshima | 273/85 CP |
| 4,651,997 | 3/1987 | Wood | 273/292 |
| 4,659,087 | 4/1987 | Shen et al. | 273/292 |
| 4,861,041 | 8/1989 | Jones et al. | 273/292 |
| 5,013,049 | 5/1991 | Tomaszewski | 273/292 |
| 5,078,405 | 1/1992 | Jones et al. | 273/309 |
| 5,098,107 | 3/1992 | Boylan et al. | 273/274 |

OTHER PUBLICATIONS

Scarne's New Complete Guide to Gambling, John Scarne published 1974, pp. 342–361.

*Primary Examiner*—Benjamin H. Layno
*Attorney, Agent, or Firm*—John Edward Roethel

[57] ABSTRACT

A modified method of playing blackjack or Twenty-One where a player plays the same hand against two or more successively dealt dealer's hands. To begin the game each player makes one or more antes to be eligible to participate against each of the dealer's hands. Each player and the dealer are dealt two cards with at least one of the dealer's cards turned face-up. Each player and the dealer then takes hits or stands according to the conventional manner of play of Twenty-One. The dealer's first hand is compared to the player's single hand. Winning player's wagers are paid and losing player's wages are collected, but only relative to the player's first ante. The dealer discards his first hand except for his face-up card, and then using the face-up card the dealer deals himself a "second" hand according to the conventional manner of play of Twenty-One. The dealer's second hand is compared to each of the player's same hand that the players played against the dealer's first hand. Again, winning player's wagers are paid and losing player's wagers are collected, but only relative to the player's second ante.

16 Claims, 2 Drawing Sheets

METHOD OF PLAYING MULTIPLE ACTION BLACKJACK

This invention relates to a modification of the method of play of Blackjack or Twenty-One, and more particularly to a modification in which the dealer plays multiple hands of the game against a single player's hand.

BACKGROUND OF THE INVENTION

Twenty-One (also called Blackjack) is a staple of most casinos. Conventional Twenty-One involves a game of chance between a dealer and one or more players. The object is for the player to achieve a count of his hand closer to 21 than the count of the hand of the dealer; but if the count of the player's hand goes over 21 then the player loses regardless of the final count of the dealer's hand.

The conventional manner of play of Twenty-One is as follows: A standard deck of playing cards is used and each card counts its face value, except Aces which have a value of one or eleven as is most beneficial to the count of the hand. Each player initially receives two cards. The dealer also receives two cards. One of the dealer's cards is dealt face down and the other of the dealer's cards is dealt face-up. In some gaming establishments, the dealer receives his two cards at the same time that each player is dealt his two cards. In other gaming establishments, the dealer initially only receives one card which becomes the dealer's "up" card. After each player has taken additional cards, the dealer then receives his second card.

A player may draw additional cards (take "hits") in order to try and beat the count of the dealer's hand. If the player's count exceeds 21, the player "busts." The player may "stand" on any count of 21 or less. When a player busts, he loses his wager regardless of whether or not the dealer busts.

After all of the players have taken hits or have stood on their hand, the dealer "stands" or "hits" based on preestablished rules for the game. Typically, if the dealer has less than 17, the dealer must take a hit. If the dealer has 17 or more, the dealer stands.

As the game of Twenty-One is played in most legalized gaming establishments, the conventional manner of play requires the dealer to take a hit whenever the dealer's hand is a "soft 17" count. However in other gaming establishments, the dealer stands on a "soft 17" count. The term "soft" means that the Ace is valued as a count of 1, instead of as a count of 11. A soft 17 occurs when the dealer has an Ace and a Six (or multiple cards that add up to 6). The dealer will stand on soft 18's, soft 19's and soft 20's.

After the dealer's final hand has been established, the numerical count of the dealer's hand is compared to the numerical count of the player's hand. If the dealer busts, the player wins regardless of the numerical count of his hand. If neither the player nor the dealer have busted, the closest hand to a numerical count of 21, without going over, wins; tie hands are a "push."

There are other procedures that are included in the conventional manner of play of Twenty-One. One well-known procedure is "Doubling Down." If the player's first two cards have a combined value of 10 or 11, the player may "double down" on his hand. The player turns both of his cards face-up in front of him and makes a second wager equal to the amount of his initial ante. The dealer deals to the player one additional card and the resulting three card hand establishes the numerical count for the player's hand. The most widely used "Doubling Down" rules permit the player to "double down" only on 10 or 11 counts. Other variations allow players to "double down" on 9, 10 or 11; only on 11; or on any two cards.

Another well-known procedure is "Splitting Pairs." If the player's first two cards are a pair, the player may "split" those cards into two separate hands. His original ante is applied to one of the hands and he makes an additional ante for the other hand. The player receives a new second card for each of the split hands. Each of the split hands is played separately and the player proceeds by standing or taking hits until he has achieved a hand count upon which he wishes to stand or busts.

The player may "double down" on either or both of his split hands if he is eligible to do so under the "Doubling Down" rules. The player may split again if he pairs up on either or both of his split hands. In most gaming establishments, a player may also split his hand if both of his initial cards are ten count cards (Tens, Jacks, Queens or Kings). For example, a player can split if he receives a Ten and a Queen, or a Jack and a King, or any combination of ten count cards. Because a hand count of 20 is a good hand to have, most experienced Twenty-One players are reluctant to risk such a hand by "splitting".

Another well-known procedure is "Insurance." If the dealer's up card is an Ace, the player may make an additional "insurance" bet. The insurance bets are made after each player receives his first two cards and the dealer reveals his up card and before any additional cards are dealt. When the dealer's up card is an Ace, each player can wager one-half of the amount of his original ante as insurance against the dealer having a Blackjack, i.e. a two-card 21 count (an Ace and a 10 count card such as a King, Queen, Jack or Ten). If the dealer has a two-card 21 count, the player loses on his original ante but wins two-to-one odds on his second "insurance" bet. Also if the dealer has a two-card 21 count, that round of the game is over and all players lose except those who also have two-card 21 counts who tie or "push" with the dealer. If the dealer does not have a two-card 21 count, the player loses on his "insurance" bet and the round of the game continues.

As used in this disclosure and the accompanying claims, the terms "conventional Twenty-One" and "the conventional manner of play of Twenty-One" mean the game of Twenty-One as previously described and also including any of the known variations of the game of Twenty-One.

Twenty-One has remained remarkably unchanged over the years. There have been a few other modifications proposed to the basic game, but none of these modifications have achieved universal popularity. For example, in the conventional manner of play of a Twenty-One game, the dealer shows one (the "up" card) of his first two cards and the other card (the "hole" card) is kept hidden until all the players have drawn to their hands. One modification involves the dealer showing both of his cards face-up before the players draw. This improves the player's odds of winning and the payout odds have been modified to adjust for this change so that the house's advantage remains.

A disadvantage of conventional Twenty-One is that each round of the game consists of one player's hand against one dealer's hand. Once the player draws his cards and achieves a hand count total on which he wishes to "stand," the player has only a single opportunity to win or lose because the dealer is likewise playing only a single hand.

It can also be very disappointing for the player to be dealt or draw to a hand count of 19 or 20, and have the dealer achieve a card count of 21 on his single hand. There is a need in Twenty-One for a modification in which the player has the opportunity to win more than once on a single hand.

From the perspective of the gaming establishment, the play of a round of Twenty-One takes a predictable length of time. Each player's hand as well as the dealer's hand must be dealt. Each player makes his determination of whether to hit or stand and the dealer deals additional cards to the players as requested. Once this is completed, the dealer plays his hand according to the predetermined rules for the dealer taking hits or standing. Winner's wagers are paid and loser's wagers are collected and the next round of the hand is played.

There is a need for the gaming establishment to increase the amount of revenue generated by the game of Twenty-One in the same time period without simply increasing the size of the wagers made by the player.

It is an object of the present invention to provide a method of play of the game of Twenty-One which increases the effective number of hands that can be played in the same amount of time.

It is a feature of the present invention to provide that the dealer play two or more hands of Twenty-One using the same "up" card each time while the player retains his same hand for each of the dealer's hands.

It is an advantage of the present invention that more hands of Twenty-One can be played in the same amount of time. This increases the potential revenue to the gaming establishment and provides the player with multiple opportunities to win whenever the player achieves a good hand.

Other objects, features and advantages of the present invention will become apparent from a consideration of the following detailed description.

SUMMARY OF THE INVENTION

In the method of play of the present invention, a player plays the same hand against two or more successively dealt dealer's hands. Each of the dealer's hands use the same "up" card.

More specifically, each player makes one or more antes to be eligible to participate against each of the dealer's hands played during any particular round of the game. Each player and the dealer are dealt two cards to begin the game. At least one of the dealer's cards is turned face-up. Each player then takes hits or stands, and makes additional bets such as insurance or doubling down or splitting pairs, as desired by the player. Once all of the players have completed the play, the dealer then takes hits or stands as required by the predetermined conventional manner of play of the dealer's hand. Once the dealer has completed the play of his hand, winning player's wagers are paid and losing player's wagers are collected, but only relative to the player's first ante and any additional bets that may have been made.

The dealer picks up all of his cards except for his first card that was turned face-up. The dealer then plays a "second" hand according to the predetermined method of play for the dealer. The dealer's second hand is compared to the player's existing (first) hand to determine who wins the second play. Again, winning player's wagers are paid and losing player's wagers are collected, but only relative to the player's second ante and any additional bets that may have been made. This method of play continues for the number of multiple dealer's hands that are prescribed.

DETAILED DESCRIPTION OF THE PREFERRED EMBODIMENTS

The method of the present invention comprises a modified version of Twenty-One wherein a player plays a single hand but the dealer plays more than one hand. The player makes one or more antes at the beginning of each round of the game to be eligible to play against one or more of the dealer's sequential hands. In the preferred manner of play of the present invention, each of the player's antes can be of any amount subject to the minimum and maximum size of wagers permitted by the gaming establishment. The player's antes may or may not be equal. Alternatively, the gaming establishment may require the player to make antes in equal amounts against the different dealer's hands.

The player then plays the same hand against each of the dealer's hands and winning and losing hands are determined according to the conventional manner of play of Twenty-One.

Figure 1:
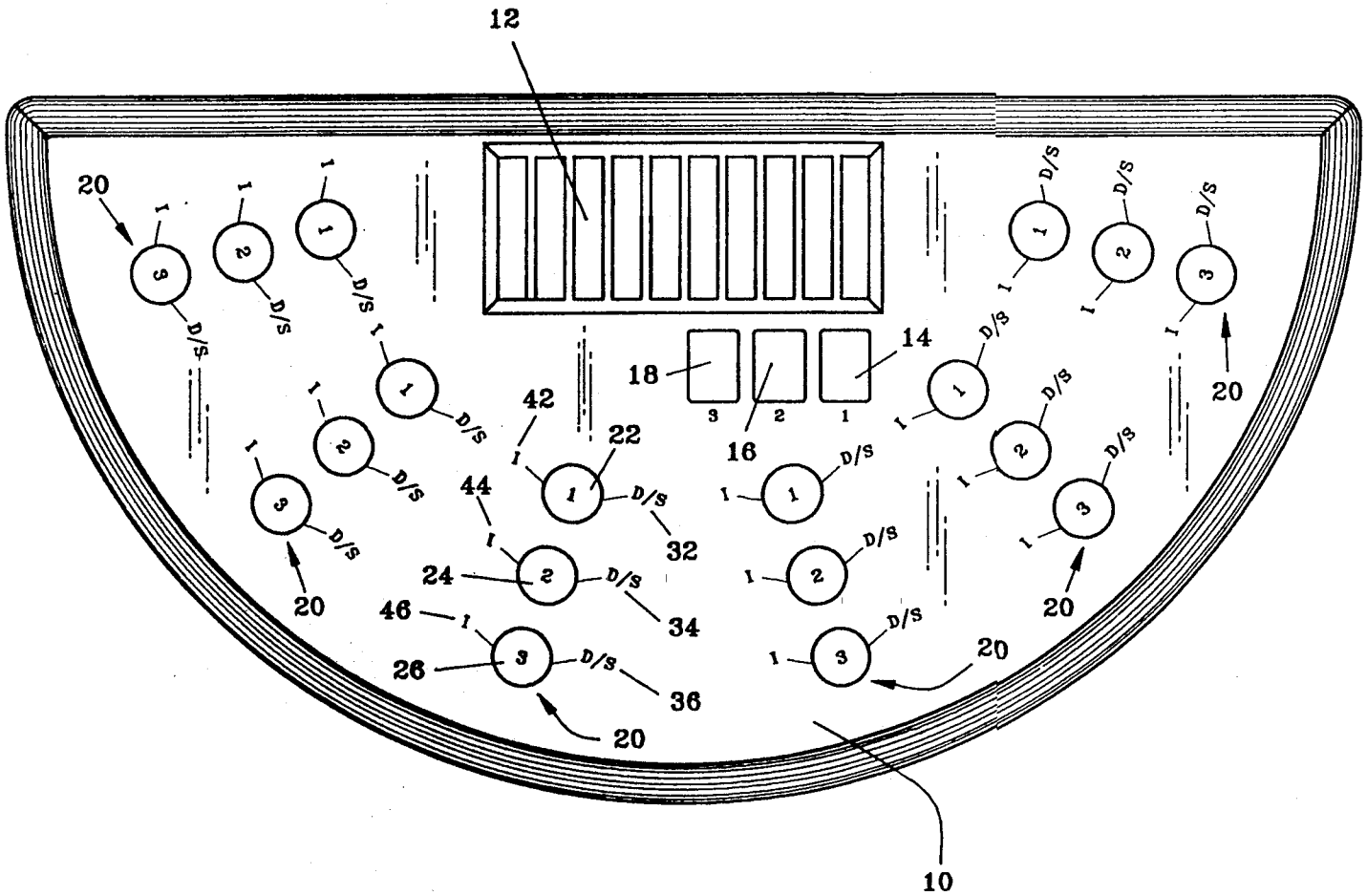
FIG. 1 shows a preferred layout that is used in connection with the modified Twenty-One method of the present invention.

FIG. 1 shows a preferred table layout that can be used with the method of the present invention. A Twenty-One table 10 is provided with a layout that has one or more individual player locations 20. A chip rack 12 is provided adjacent to the dealer's location as is conventional. Adjacent to the chip rack 12, there are provided three boxes, 14, 16 and 18 which designate the location at which the cards that constitute the dealer's first hand, second hand and third hand will be displayed.

Each player location 20 includes indicia designating locations for the player to place his various wagers relating to the method of play of the present invention. As shown in more detail in FIG. 2, each player location 20 includes a circle 22 for the player's first ante, a circle 24 for the player's second ante and a circle 26 for the player's third ante. The first betting circle 22 also has associated therewith a symbol 32 (for example, "D/S") designating the location for making a "double down" or "splitting" bet and a symbol 44 (for example, "I") designating the betting location for making an "Insurance" bet relative to the first hand. The second betting circle 24 also has associated therewith a symbol 34 ("D/S") designating the location for making a "double down" or "splitting" bet and a symbol 44 ("I") designating the betting location for making an "Insurance" bet relative to the second hand. The third betting circle 26 also has associated therewith a symbol 36 ("D/S") designating the location for making a "double down" or "splitting" bet and a symbol 46 ("I") designating the betting location for making an "Insurance" bet relative to the third hand.

In the preferred embodiment of the present invention, each player makes one or more initial antes to be eligible to participate in the play of a round of the game. The player places a first wager in circle 22 to be eligible to play against the dealer's first hand. The player places a second wager in circle 24 to be eligible to play against the dealer's second hand. The player places a third wager in circle 26 to be eligible to play against the dealer's third hand.

In the preferred embodiment of the present invention, the player may ante only in the first circle 22, in the second circle 24 and the third circle 26, or in all three circles. Alternatively, the gaming establishment may permit a player to make one or two antes using any of the three circles.

After each player has made his selected antes, the dealing of the cards commences. One or more standard decks of playing cards can be used. Each player initially receives two cards. The dealer is initially dealt two cards and this deal represents the dealer's first hand. The dealer places his cards in the box 14 with the "1" symbol designating this as the dealer's first hand. One of the dealer's cards is dealt face-up and becomes the dealer's "up" card. Alternatively, the dealer initially receives only one card, which is the dealer's up card, and the dealer does not receive his second card until all players have drawn to their hands.

The manner of play continues with the player making decisions regarding the play of his hand. The player only plays his hand once regardless of how many antes he has made to be eligible to play against the first, second or third dealer's hands. The player may draw additional cards or stand as he desires according to the conventional manner of play of Twenty-One.

The value of the dealer's up card is very important to the player in order for the player to determine what strategy he will apply in determining whether to take hits or stand on his own hand. One basic Twenty-One theory is for the player to assume that the dealer's down card has a value of 10. (Twenty of the 52 cards in a standard deck of cards have a value of 10 so the highest probability is that the dealer's down card will have a value of 10.) Thus, the value of the dealer's up card determines the probability of the dealer achieving a hand count of between 17 and 21 or the dealer busting.

For example, if the dealer's up card is a Five or a Six, the probability of the dealer busting is higher than it is if the dealer's up card is an Ace or a 10 count card. Following basic Twenty-One theory, all the player needs to know to play his hand is the value of the dealer's up card.

If the player busts on his hand, he automatically loses all bets that he has made. If the player stands on his hand, his numerical hand count is used against each of the sequential dealer's hands as they are played out.

Figure 2:
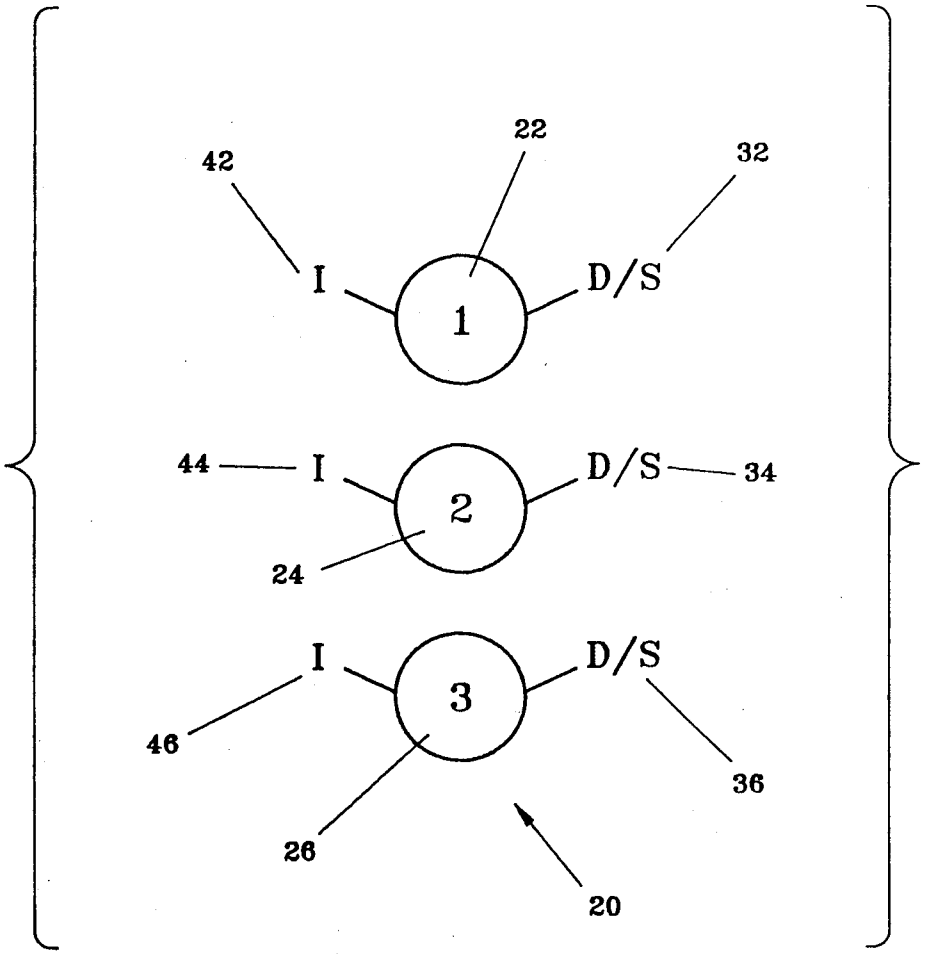
FIG. 2 shows an enlarged view of one of the player positions on the layout of the preferred embodiment of the present invention.

All of the conventional features of Twenty-One may be utilized by the player in the method of the present invention. A player may "double down," "split pairs" and take "insurance" on his hand as the conventional manner of play would permit. As shown in FIG. 2, a player may make an "insurance" wager relative to his first ante by placing the insurance wager in the location 42. "Double down" or "split" wagers relative to the first ante are made in the location designated 32. Wagering locations for "insurance" wagers and "double down" or "split wagers" are also provided relative to the player's second ante and third ante. All of the additional wagering that the player desires to make is completed before the dealer begins the play of his hands.

Once all player wagering is completed and after all of the players have taken hits or have stood on their hand, the dealer "stands" or "hits" with regard to his first hand based on the preestablished rules for the game as explained above. Any players that busted on their hand are now out of the game and have lost all of their bets. Once the dealer has completed drawing additional cards if required, the dealer compares his first hand to the hand of any remaining players and determines whether each player is a winner or a loser according to the conventional manner of play of Twenty-One. The closest to a 21 count, without going over, wins; tie hands are a "push."

Winning wagers are paid and losing wagers are collected, but the winning and losing is determined only relative to the amount of the wager made by the player in the first betting circle 22 and any additional wagers made in the "insurance" location 42 and the "double down" and "split" location 32.

After the winning wagers are paid and the losing wagers collected, the round of the game continues relative to the dealer's second hand. The dealer discards all of his cards from his first hand except for the dealer's original up card. The dealer moves his up card from the box 14 to the box 16 with the symbol "2" designating the dealer's second hand. Using his original up card as part of his second hand, the dealer receives at least one more card and then stands or takes additional cards as part of his second hand in accordance with the conventional manner of play of Twenty-One.

Once the dealer has completed drawing additional cards if required for his second hand, the dealer compares his second hand to the player's hand and determines whether each player is a winner or a loser according to the conventional manner of play of Twenty-One. Winning wagers are paid and losing wagers are collected, but the winning and losing is determined only relative to the amount of the wager made by the player in the second betting circle 24 and any additional wagers made in the "insurance" location 44 and the "double down" and "split" location 34.

After these winning wagers are paid and the losing wagers collected, the round of the game continues relative to the dealer's third hand. The dealer discards all of his cards from his second hand except for the dealer's original up card. The dealer moves his up card from the box 16 to the box 18 with the symbol "3" designating the dealer's third hand. Using his original up card as part of his third hand, the dealer receives one more card and then stands or takes additional cards as part of his third hand in accordance with the conventional manner of play of Twenty-One.

Once the dealer has completed drawing additional cards if required for his third hand, the dealer compares his third hand to the player's hand and determines whether each player is a winner or a loser according to the conventional manner of play of Twenty-One. Winning wagers are paid and losing wagers are collected, but the winning and losing is determined only relative to the amount of the wager made by the player in the third betting circle 26 and any additional wagers made in the "insurance" location 46 and the "double down" and "split" location 36.

The method of play may continue for fourth and subsequent dealer's hands depending on how many dealer's hands the gaming establishment permits to be used during a single round of play.

Depending on the desires of the gaming establishment and the regulations of the gaming body that may be overseeing the play of the game, the present invention may be limited to only a first and second dealer's hands or may utilize more than three dealer's hands. Theoretical analysis indicates that the percentage in favor of the gaming establishment is approximately the same under the method of play of the present invention as compared to conventional Twenty-One.

The method of play of the present invention is also applicable to electronic versions of Twenty-One played on electronic gaming devices, generally referred to as Video Twenty-One. Such devices may be configured to allow a single player to play against the dealer or there may be multiple player stations all playing against a single dealer. Representative of the latter type of electronic Video Twenty-One is U.S. Pat. No. 4,614,342 to Takashima, incorporated herein by this reference.

In the electronic version, the live dealer is replaced by computer hardware and software, but the method of play of the game is the same as that of the live version described above.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A method of playing a modified version of Twenty-One wherein a player plays a single hand and a dealer plays more than one hand comprising:

a) a player making a first ante to be eligible to participate in the first hand played by the dealer, b) a player making a second ante to be eligible to participate in the second hand played by the dealer, c) the dealer dealing two cards to the player and at least one card to the dealer representing the dealer's first hand, one card of the dealer's first hand being dealt face-up, d) the player standing or receiving additional cards from the dealer as the player desires in accordance with the conventional manner of play of Twenty-One, defining the player's single-hand.

e) the dealer standing or receiving additional cards as part of his first hand in accordance with the conventional manner of play of Twenty-One, f) the dealer comparing his first hand to the player's single hand in accordance with the conventional manner of play of Twenty-One, g) the dealer paying the player based on the amount of the player's first ante if the player's single hand beats the dealer's first hand or collecting the player's first ante if the dealer's first hand beats the player's single hand in accordance with the conventional manner of play of Twenty-One, h) the dealer using only the face-up card from his first hand as part of his second hand, i) the dealer standing or receiving additional cards as part of his second hand in accordance with the conventional manner of play of Twenty-One, j) the dealer comparing his second hand to the player's single hand in accordance with the conventional manner of play of Twenty-One, the player's hand being the same hand that the player played against the dealer's first hand.

k) the dealer paying the player based on the player's second ante if the player's single hand beats the dealer's second hand or collecting the player's second ante if the dealer's second hand beats the player's single hand in accordance with the conventional manner of play of Twenty-One.

2. The method of play described in claim 1 further including the player making an additional wager in the form of a double down bet relative to his first or second ante.

3. The method of play described in claim 1 further including the player making an additional wager in the form of an insurance bet relative to his first or second ante.

4. A method of playing a modified version of Twenty-One wherein a player plays a single hand and a dealer plays more than one hand comprising:

a) the dealer dealing two cards to the player and at least one card to the dealer representing the dealer's first hand, one card of the dealer's first hand being dealt face-up, b) the player standing or receiving additional cards from the dealer as the player desires in accordance with the conventional manner of play of Twenty-One, defining the player's single hand, c) the dealer standing or receiving additional cards as part of his first hand in accordance with the conventional manner of play of Twenty-One, d) the dealer comparing his first hand to the player's single hand in accordance with the conventional manner of play of Twenty-One, e) the player winning if the player's single hand beats the dealer's first hand or the player losing if the dealer's first hand beats the player's single hand in accordance with the conventional manner of play of Twenty-One, f) the dealer using the face-up card from his first hand as part of his second hand, g) the dealer standing or receiving additional cards as part of his second hand in accordance with the conventional manner of play of Twenty-One, h) the dealer comparing his second hand to the player's single hand in accordance with the conventional manner of play of Twenty-One, the player's hand being the same hand that the player played against the dealer's first hand.

i) the player winning if the player's single hand beats the dealer's second hand or the player losing if the dealer's second hand beats the player's single hand in accordance with the conventional manner of play of Twenty-One.

5. A method of playing a modified version of Twenty-One wherein a player plays a single hand and a dealer plays more than one hand comprising:

a) a player making a first ante to be eligible to participate in the first hand played by the dealer, b) a player making a second ante to be eligible to participate in the second hand played by the dealer, c) a player making a third ante to be eligible to participate in the third hand played by the dealer, d) the dealer dealing two cards to the player and at least one card to the dealer representing the dealer's first hand, one card of the dealer's first hand being dealt face-up, e) the player standing or receiving additional cards from the dealer as the player desires in accordance with the conventional manner of play of Twenty-One, defining the player's single hand, f) the dealer standing or receiving additional cards as part of his first hand in accordance with the conventional manner of play of Twenty-One, g) the dealer comparing his first hand to the player's single hand in accordance with the conventional manner of play of Twenty-One, h) the dealer paying the player based on the amount of the player's first ante if the player's single hand beats the dealer's first hand or collecting the player's first ante if the dealer's first hand beats the player's single hand in accordance with the conventional manner of play of Twenty-One, i) the dealer using only the face-up card from his first hand as part of his second hand, j) the dealer standing or receiving additional cards as part of his second hand in accordance with the conventional manner of play of Twenty-One, k) the dealer comparing his second hand to the player's hand in accordance with the conventional manner of play of Twenty-One, the player's hand being the same hand that the player played against the dealer's first hand.

l) the dealer paying the player based on the player's second ante if the player's single hand beats the dealer's second hand or collecting the player's second ante if the dealer's second hand beats the player's single hand in accordance with the conventional manner of play of Twenty-One, m) the dealer using only the face-up card from his second hand as part of his third hand, n) the dealer standing or receiving additional cards as part of his third hand in accordance with the conventional manner of play of Twenty-One, o) the dealer comparing his third hand to the player's single hand in accordance with the conventional manner of play of Twenty-One, the player's hand being the same hand that the player played against the dealer's first hand.

p) the dealer paying the player based on the player's third ante if the player's single hand beats the dealer's third hand or collecting the player's third ante if the dealer's third hand beats the player's single hand in accordance with the conventional manner of play of Twenty-One.

6. The method of play described in claim 5 further including the player making an additional wager in the form of a double down bet relative to his first, second or third ante.

7. The method of play described in claim 5 further including the player making an additional wager in the form of an insurance bet relative to his first, second or third ante.

8. A method of playing a modified version of Twenty-One wherein a player plays a single hand and a dealer plays more than one hand comprising:

a) the dealer dealing two cards to the player and at least one card to the dealer representing the dealer's first hand, one card of the dealer's first hand being dealt face-up, b) the player standing or receiving additional cards from the dealer as the player desires in accordance with the conventional manner of play of Twenty-One, defining the player's single hand, c) the dealer standing or receiving additional cards as part of his first hand in accordance with the conventional manner of play of Twenty-One, d) the dealer comparing his first hand to the player's single hand in accordance with the conventional manner of play of Twenty-One, e) the player winning if the player's single hand beats the dealer's first hand or the player losing if the dealer's first hand beats the player's single hand in accordance with the conventional manner of play of Twenty-One, f) the dealer using only the face-up card from his first hand as part of his second hand, g) the dealer standing or receiving additional cards as part of his second hand in accordance with the conventional manner of play of Twenty-One, h) the dealer comparing his second hand to the player'single hand in accordance with the conventional manner of play of Twenty-One, the player's hand being the same hand that the player played against the dealer's first hand.

i) the player winning if the player's single hand beats the dealer's second hand or the player losing if the dealer's second hand beats the player's single hand in accordance with the conventional manner of play of Twenty-One, j) the dealer using only the face-up card from his second hand as part of his third hand, k) the dealer standing or receiving additional cards as part of his third hand in accordance with the conventional manner of play of Twenty-One, l) the dealer comparing his third hand to the player's single hand in accordance with the conventional manner of play of Twenty-One, the player's hand being the same hand that the player played against the dealer's first hand.

m) the player winning if the player's single hand beats the dealer's third hand or the player losing if the dealer's third hand beats the player's single hand in accordance with the conventional manner of play of Twenty-One.

9. A method of playing a modified version of Twenty-One wherein a player plays a single hand and a dealer plays more than one hand utilizing an electronic display of the game comprising:

a) a player making a first ante to be eligible to participate in the first hand played by the dealer, b) a player making a second ante to be eligible to participate in the second hand played by the dealer, c) displaying two cards to the player representing the player's hand and at least one card to the dealer representing the dealer's first hand, one card of the dealer's first hand being displayed face-up, d) the player standing or the player drawing additional cards as the player desires in accordance with the conventional manner of play of Twenty-One, defining the player's single hand, e) the dealer standing or receiving additional cards as part of his first hand in accordance with the conventional manner of play of Twenty-One, f) comparing the dealer's first hand to the player's single hand in accordance with the conventional manner of play of Twenty-One, g) paying the player based on the amount of the player's first ante if the player's single hand beats the dealer's first hand or collecting the player's first ante if the dealer's first hand beats the player's single hand in accordance with the conventional manner of play of Twenty-One, h) using only the face-up card from the dealer's first hand as part of the dealer's second hand, i) the dealer standing or receiving additional cards as part of his second hand in accordance with the conventional manner of play of Twenty-One, j) comparing the dealer's second hand to the player's single hand in accordance with the conventional manner of play of Twenty-One, the player's hand being the same hand that the player played against the dealer's first hand.

k) paying the player based on the player's second ante if the player's single hand beats the dealer's second hand or collecting the player's second ante if the dealer's second hand beats the player's single hand in accordance with the conventional manner of play of Twenty-One.

10. The method of play described in claim 9 further including the player making an additional wager in the form of a double down bet relative to his first or second ante.

11. The method of play described in claim 9 further including the player making an additional wager in the form of an insurance bet relative to his first or second ante.

12. A method of playing a modified version of Twenty-One wherein a player plays a single hand and a dealer plays more than one hand utilizing an electronic display of the game comprising:

a) displaying two cards to the player representing the player's hand and at least one card to the dealer representing the dealer's first hand, one card of the dealer's first hand being displayed face-up, b) the player standing or the player drawing additional cards as the player desires in accordance with the conventional manner of play of Twenty-One, defining the player's single hand, c) the dealer standing or receiving additional cards as part of his first hand in accordance with the conventional manner of play of Twenty-One, d) comparing the dealer's first hand to the player's single hand in accordance with the conventional manner of play of Twenty-One, e) the player winning if the player's single hand beats the dealer's first hand or the player losing if the dealer's first hand beats the player's single hand in accordance with the conventional manner of play of Twenty-One, f) using only the face-up card from the dealer's first hand as part of the dealer's second hand, g) the dealer standing or receiving additional cards as part of his second hand in accordance with the conventional manner to play of Twenty-One, h) comparing the dealer's second hand to the player's single hand in accordance with the conventional manner of play of Twenty-One, the player's hand being the same hand that the player played against the dealer's first hand.

i) the player winning if the player's single hand beats the dealer's second hand or the player losing if the dealer's second hand beats the player's single hand in accordance with the conventional manner of play of Twenty-One.

13. A method of playing a modified version of Twenty-One wherein a player plays a single hand and a dealer plays more than one hand utilizing an electronic display of the game comprising:

a) a player making a first ante to be eligible to participate in the first hand played by the dealer, b) a player making a second ante to be eligible to participate in the second hand played by the dealer, c) a player making a third ante to be eligible to participate in the third hand played by the dealer, d) displaying two cards to the player representing the player's hand and at least one card to the dealer representing the dealer's first hand, one card of the dealer's first hand being dealt face-up, e) the player standing or the player drawing additional cards as the player desires in accordance with the conventional manner of play of Twenty-One, defining the player's single hand, f) the dealer standing or receiving additional cards as part of his first hand in accordance with the conventional manner of play of Twenty-One, g) comparing the dealer's first hand to the player's single hand in accordance with the conventional manner of play of Twenty-One, h) paying the player based on the amount of the player's first ante if the player's single hand beats the dealer's first hand or collecting the player's first ante if the dealer's first hand beats the player's single hand in accordance with the conventional manner of play of Twenty-One, i) using only the face-up card from the dealer's first hand as part of the dealer's second hand, j) the dealer standing or receiving additional cards as part of his second hand in accordance with the conventional manner of play of Twenty-One, k) comparing the dealer's second hand to the player's single hand in accordance with the conventional manner of play of Twenty-One, the player's hand being the same hand that the player played against the dealer's first hand.

l) paying the player based on the player's second ante if the player's single hand beats the dealer's second hand or collecting the player's second ante if the dealer's second hand beats the player's single hand in accordance with the conventional manner of play of Twenty-One, m) using only the face-up card from the dealer's second hand as part of the dealer's third hand, n) the dealer standing or receiving additional cards as part of his third hand in accordance with the conventional manner of play of Twenty-One, o) comparing the dealer's third hand to the player's single hand in accordance with the conventional manner of play of Twenty-One, the player's hand being the same hand that the player played against the dealer's first hand.

p) paying the player based on the player's third ante if the player's single hand beats the dealer's third hand or collecting the player's third ante if the dealer's third hand beats the player's single hand in accordance with the conventional manner of play of Twenty-One.

14. The method of play described in claim 13 further including the player making an additional wager in the form of a double down bet relative to his first, second or third ante.

15. The method of play described in claim 13 further including the player making an additional wager in the form of an insurance bet relative to his first, second or third ante.

16. A method of playing a modified version of Twenty-One wherein a player plays a single hand and a dealer plays more than one hand utilizing an electronic display of the game comprising:

a) displaying two cards to the player representing the player's hand and at least one card to the dealer representing the dealer's first hand, one card of the dealer's first hand being dealt face-up, b) the player standing or receiving additional cards as the player desires in accordance with the conventional manner of play of Twenty-One, defining the player's single hand, c) the dealer standing or receiving additional cards as part of the dealer's first hand in accordance with the conventional manner of play of Twenty-One, d) comparing the dealer's first hand to the player's single hand in accordance with the conventional manner of play of Twenty-One, e) the player winning if the player's single hand beats the dealer's first hand or the player losing if the dealer's first hand beats the player's single hand in accordance with the conventional manner of play of Twenty-One, f) using only the face-up card from the dealer's first hand as part of the dealer's second hand, g) the dealer standing or receiving additional cards as part of the dealer's second hand in accordance with the conventional manner of play of Twenty-One, h) comparing the dealer's second hand to the player's single hand in accordance with the conventional manner of play of Twenty-One, the player's hand being the same hand that the player played against the dealer's first hand.

i) the player winning if the player's single hand beats the dealer's second hand or the player losing if the dealer's second hand beats the player's single hand in accordance with the conventional manner of play of Twenty-One, j) using only the face-up card from the dealer's second hand as part of the dealer's third hand, k) the dealer standing or receiving additional cards as part of the dealer's third hand in accordance with the conventional manner of play of Twenty-One, l) comparing the dealer's third hand to the player's single hand in accordance with the conventional manner of play of Twenty-One, the player's hand being the same hand that the player played against the dealer's first hand.

m) the player winning if the player's single hand beats the dealer's third hand or the player losing if the dealer's third hand beats the player's single hand in accordance with the conventional manner of play of Twenty-One.

* * * * *